US008201286B1

(12) United States Patent
Parker

(10) Patent No.: US 8,201,286 B1
(45) Date of Patent: Jun. 19, 2012

(54) SHOWER CURTAIN HOLDING ASSEMBLY

(76) Inventor: William D. Parker, Ocala, FL (US)

( * ) Notice: Subject to any disclaimer, the term of this patent is extended or adjusted under 35 U.S.C. 154(b) by 53 days.

(21) Appl. No.: 12/838,174

(22) Filed: Jul. 16, 2010

(51) Int. Cl.
*A47K 3/00* (2006.01)

(52) U.S. Cl. ..... 4/609

(58) Field of Classification Search ..... 4/596, 605, 4/607–610; 160/330
See application file for complete search history.

(56) References Cited

U.S. PATENT DOCUMENTS

| | | | | | |
|---|---|---|---|---|---|
| 1,654,002 | A | * | 12/1927 | Kleinhamer | 160/349.2 |
| 2,293,883 | A | * | 8/1942 | Bossert | 160/349.2 |
| 2,855,041 | A | * | 10/1958 | Blashfield et al. | 160/336 |
| 4,126,172 | A | | 11/1978 | Faragher, Jr. | |
| 4,229,842 | A | * | 10/1980 | Gilmore | 4/610 |
| 5,070,551 | A | | 12/1991 | Harrison et al. | |
| 5,103,531 | A | * | 4/1992 | Perrotta | 16/87.4 R |
| 5,662,297 | A | | 9/1997 | Christensen et al. | |
| 5,732,420 | A | * | 3/1998 | Micciche | 4/610 |
| 5,787,954 | A | | 8/1998 | Herrera | |
| 5,809,589 | A | * | 9/1998 | Johnson | 4/609 |
| 5,894,642 | A | | 4/1999 | Eberhardt | |
| 6,041,454 | A | | 3/2000 | Summerford | |
| 6,049,920 | A | | 4/2000 | Mochizuki | |
| D534,062 | S | | 12/2006 | van den Bosch | |
| D543,839 | S | | 6/2007 | Cooper et al. | |
| 7,350,244 | B1 | | 4/2008 | Handley | |
| 2004/0178310 | A1 | * | 9/2004 | Marion | 248/251 |

* cited by examiner

*Primary Examiner* — Lori Baker

(57) ABSTRACT

A shower curtain holding assembly is provided for preventing a shower curtain from billowing into contact with a person taking a shower. The shower curtain holding assembly includes a pole member having a first end and a second end. A first hook member is coupled to the first end of the pole member. Similarly, a second hook member is coupled to the second end of the pole member. The first hook member and the second hook member are designed for coupling to a support structure such that the pole member is supported adjacent to a shower curtain to restrict movement of the shower curtain inwardly towards a person showering. In an embodiment, one end of the pole member is pivotally coupled to a wall adjacent to the shower curtain for semi-permanent installation.

16 Claims, 5 Drawing Sheets

SHOWER CURTAIN HOLDING ASSEMBLY

BACKGROUND OF THE DISCLOSURE

Field of the Disclosure

The disclosure relates to curtain holders and more particularly pertains to a new curtain holder for preventing a shower curtain from billowing into contact with a person taking a shower.

SUMMARY OF THE DISCLOSURE

An embodiment of the disclosure meets the needs presented above by generally comprising a pole member having a first end and a second end. A first hook member is coupled to the first end of the pole member. Similarly, a second hook member is coupled to the second end of the pole member. The first hook member and the second hook member are designed for coupling to a support structure such that the pole member is supported adjacent to a shower curtain to restrict movement of the shower curtain inwardly towards a person showering. In an embodiment, one end of the pole member is pivotally coupled to a wall adjacent to the shower curtain for semi-permanent installation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
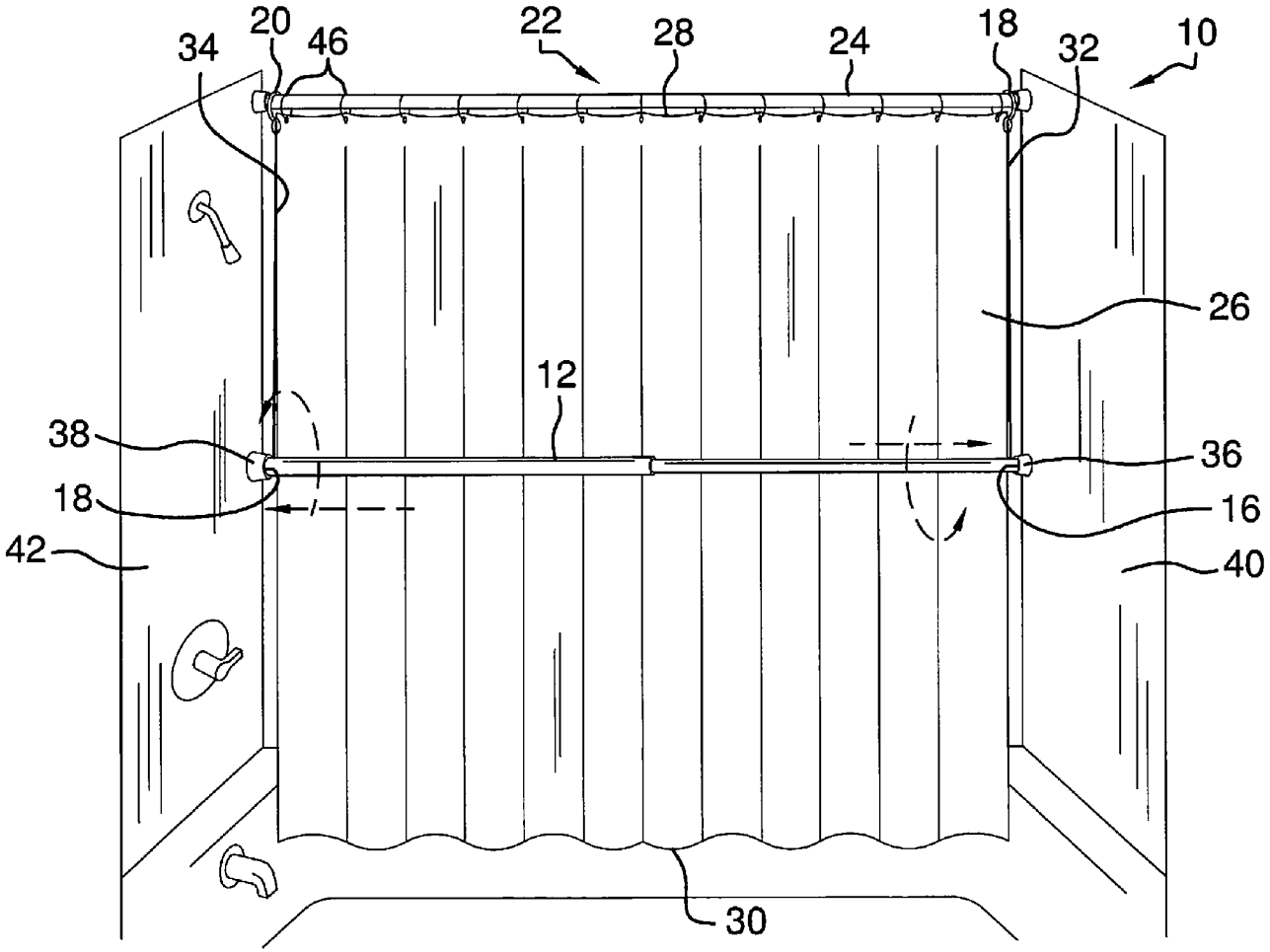
FIG. 1 is a front in-use view of a shower curtain holding assembly according to an embodiment of the disclosure.

With reference now to the drawings, and in particular to FIGS. 1 through 5 thereof, a new curtain holder embodying the principles and concepts of an embodiment of the disclosure and generally designated by the reference numeral 10 will be described.

Figure 2:
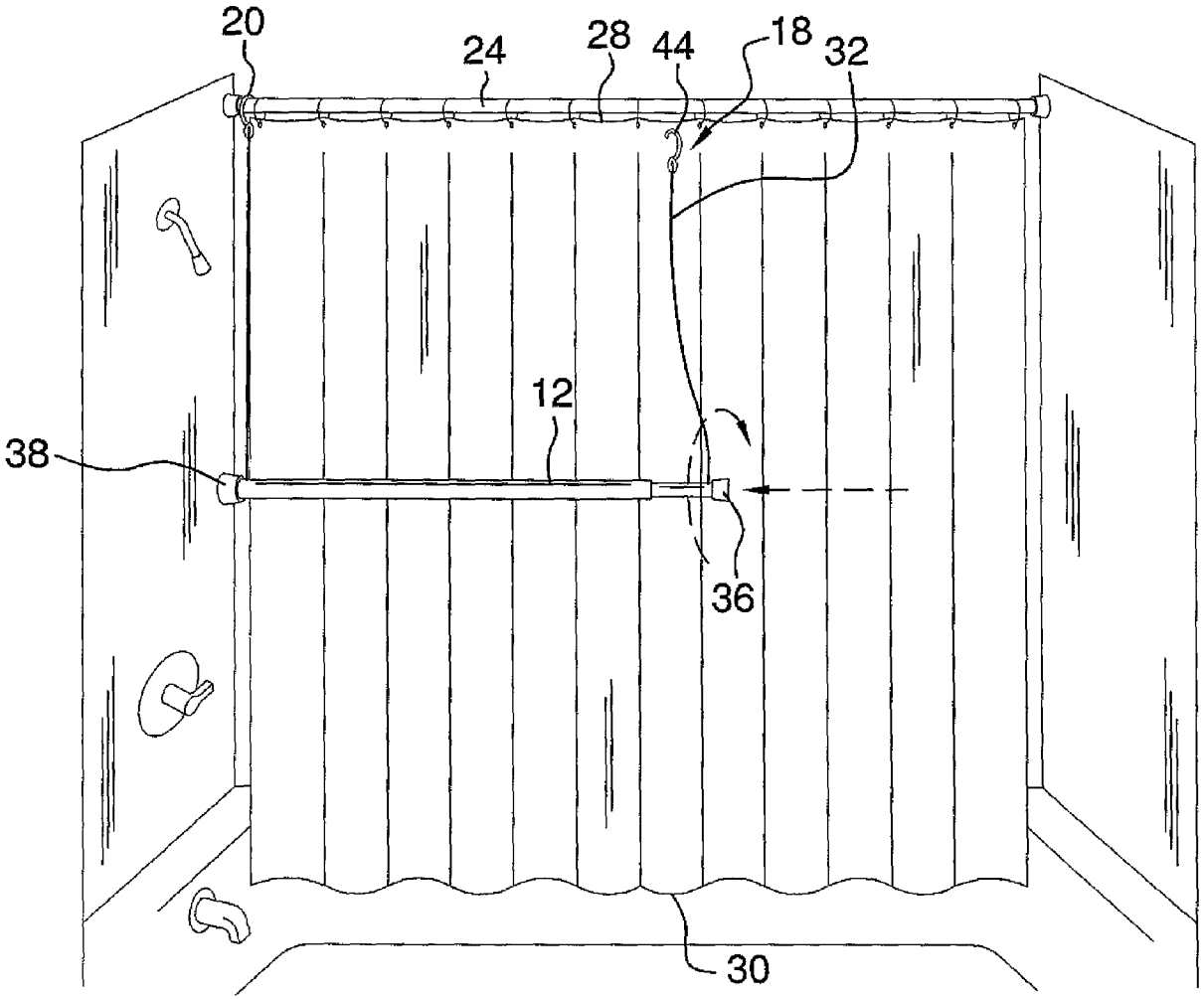
FIG. 2 is a front view of an embodiment of the disclosure partially deployed.
Figure 3:
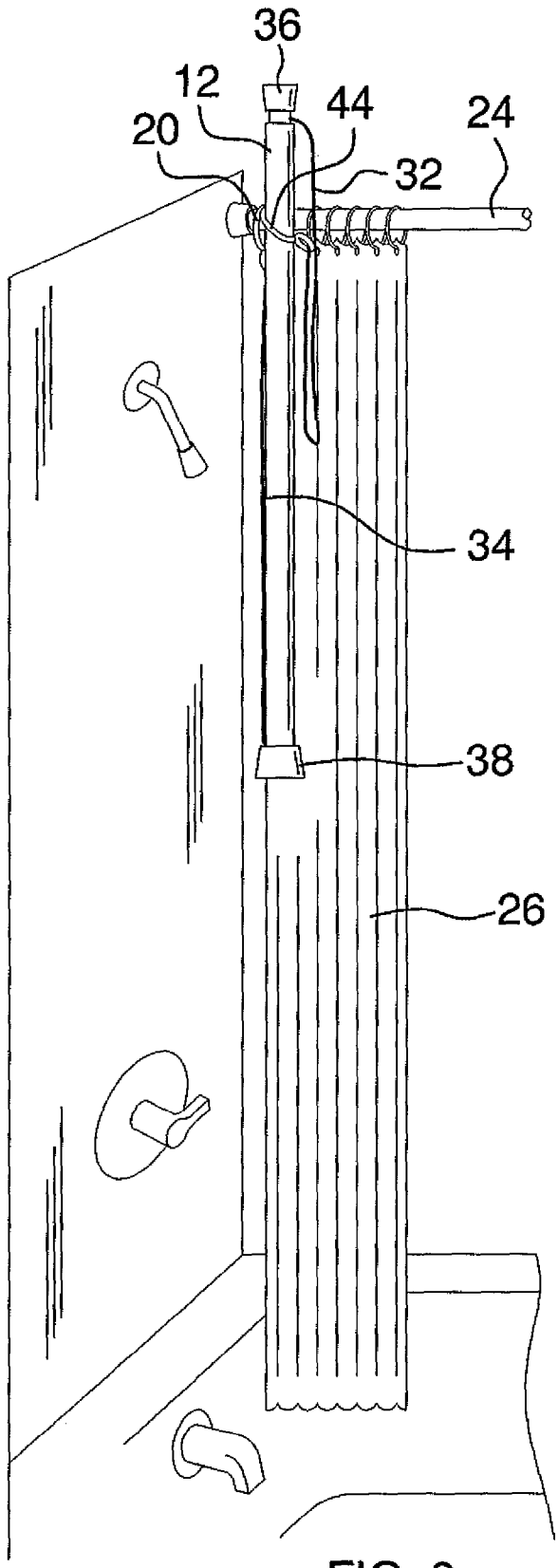
FIG. 3 is a front view of an embodiment of the disclosure in a stored position.

As best illustrated in FIGS. 1 through 3, an embodiment of the shower curtain holding assembly 10 generally comprises a pole member 12 having a first end 14 and a second end 16. A first hook member 18 is coupled to the first end 14 of the pole member 12. Similarly, a second hook member 20 is coupled to the second end 16 of the pole member 12. The first hook member 18 and the second hook member 20 are designed for coupling to a support structure 22, more particularly a shower curtain rod 24 supporting a shower curtain 26 positioned proximate to the pole member 12. The pole member 12 is supported adjacent to the shower curtain 26 and extends across the shower curtain 26 between a top 28 of the shower curtain 26 and a bottom 30 of the shower curtain 26. Thus, the pole member 12 restricts movement of the shower curtain 26 inwardly towards a person showering.

A first line 32 extends between the first end 14 of the pole member 12 and the first hook member 18. A second line 34 extends between the second end 16 of the pole member 12 and the second hook member 20. The first line 32 and the second line 34 may be constructed of a non-absorbent material or coated by a non-absorbent material such as wax. The first line 32 and the second line 34 support the pole member 12 adjacent to the shower curtain 26 in spaced relationship with the shower curtain rod 24. The first line 32 may have a length equal to a length of the second line 34 whereby the pole member 12 is positioned parallel to the shower curtain rod 24 during use.

The pole member 12 is extendable such that the pole member 12 is designed for extending across a full width of the shower curtain 26. A first stopper 36 is coupled to the first end 14 of the pole member 12. A second stopper 38 is coupled to the second end 16 of the pole member 12. The first stopper 36 and the second stopper 38 are designed for frictionally engaging opposite walls 40,42 proximate the shower curtain 26 to facilitate holding the pole member 12 in a static position during use.

The first hook member 18 has an arcuate portion 44. The arcuate portion 44 has a radius greater than a radius of the pole member 12 such that the first hook member 18 may be inserted through a shower curtain ring 46 while the first hook member 18 simultaneously receives the pole member 12. Thus, the pole member 12 may be positioned out of the way in a position transverse to the shower curtain rod 24.

Figure 4:
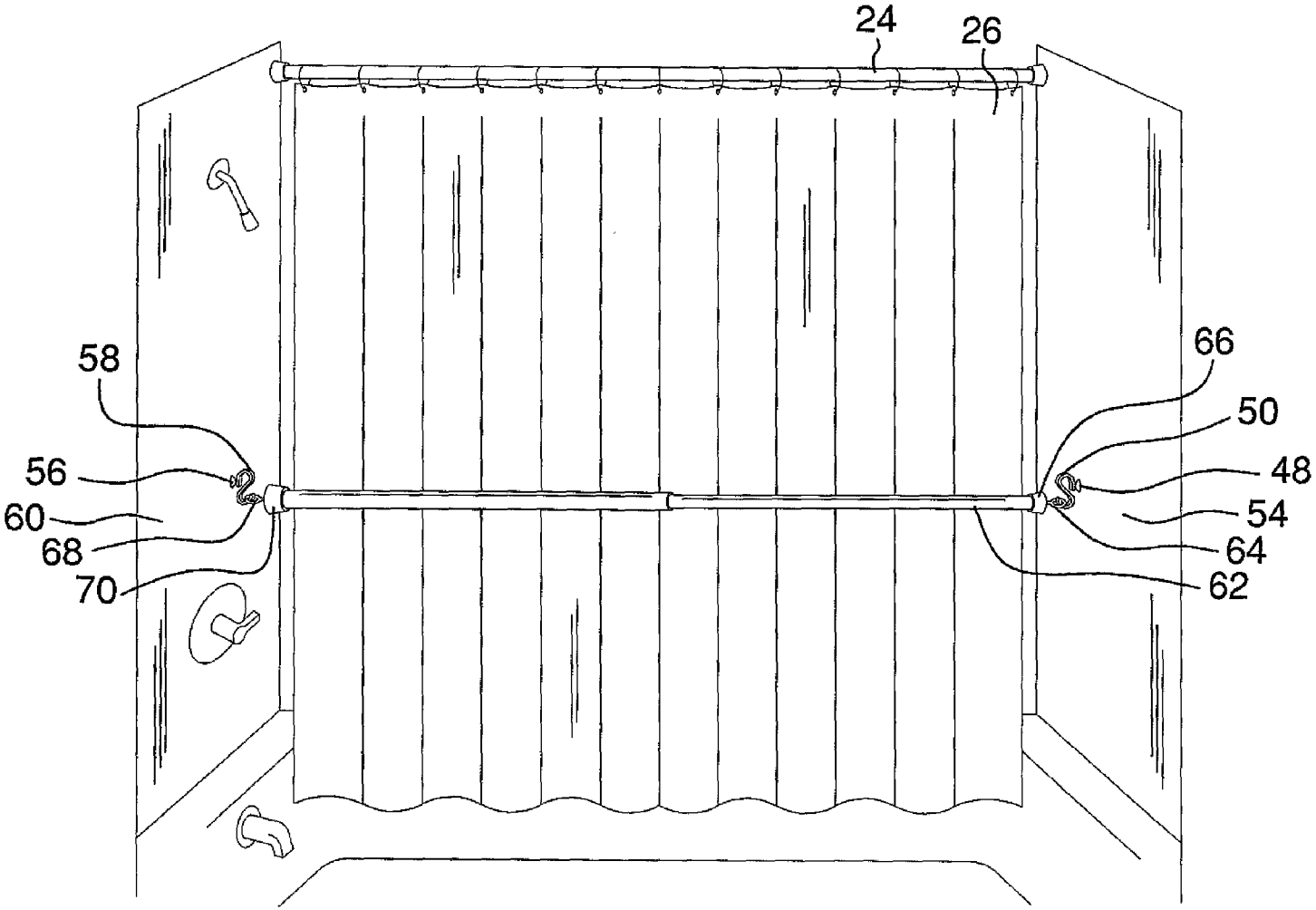
FIG. 4 is a front in-use view of an alternate embodiment of the disclosure.

In an alternate embodiment shown in FIG. 4, a first suction cup 48 is coupled to a first hook member 50 to secure the first hook member to a first surface 54 adjacent to the shower curtain 26. Similarly, a second suction cup 56 is coupled to a second hook member 58 designed for being secured to a second surface 60 opposite the first surface 54. Thus, an extendable pole member 62 may be secured adjacent to the shower curtain 26. A first loop member 64 is coupled a first end 66 of the pole member 62. The first loop member 64 is coupled to the first hook member 50. A second loop member 68 is coupled to a second end 70 of the pole member 62 and the second hook member 58 to hold the pole member 62 in the desired position.

Figure 5:
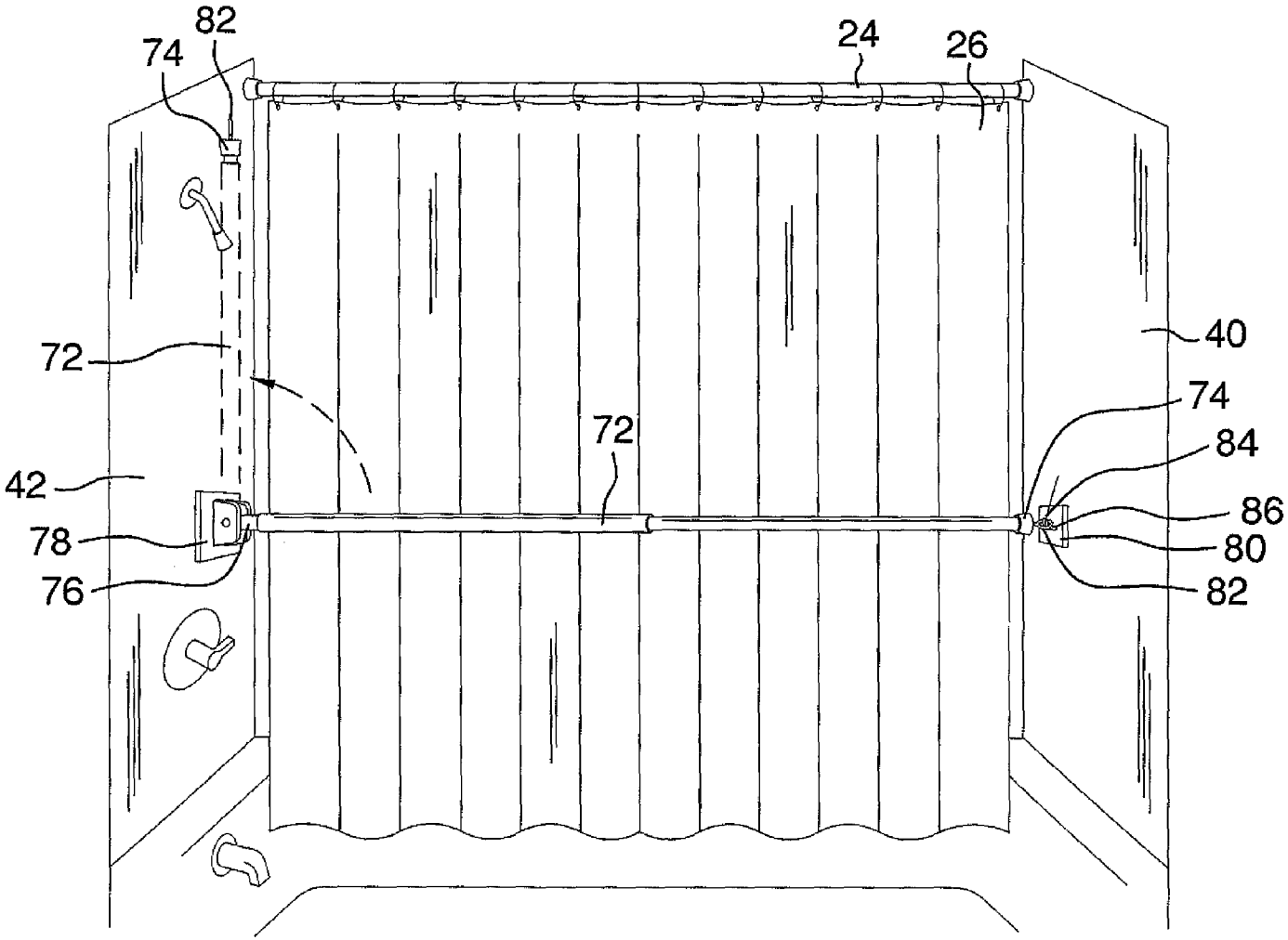
FIG. 5 is a front in-use view of an alternate embodiment of the disclosure.

In another embodiment shown in FIG. 5, a pole member 72 has a first end 74 and a second end 76. A wall mount member 78 is designed for coupling to the wall 42 proximate the shower curtain 26. The second end 76 of the pole member 72 is pivotally coupled to the wall mount member 78 such that the pole member 72 is pivotable between a use position and a storage position. A wall hook member 80 is designed for coupling to the wall 40 proximate the shower curtain 26. A first end loop member 82 is coupled to and extends from the first end 74 of the pole member 72. The first end loop member 82 is positioned to engage the wall hook member 80 when the pole member 72 is pivoted into the use position such that the pole member 72 is supported adjacent to the shower curtain 26. Thus, the pole member 72 restricts movement of the shower curtain 26.

The pole member 72 is retractable for facilitating pivoting the pole member 72 into the storage position. The wall hook member 80 may be positioned relative to the wall mount member 78 such that the pole member 72 is supported in a parallel position to the shower curtain rod 24 supporting the shower curtain 26. A hook portion 84 of the wall hook member 80 may be covered by an elastomeric material 86 such as rubber.

In use, depending on the embodiment employed, the respective pole member 12, pole member 62 or pole member 72 is positioned and secured adjacent to the shower curtain 26. Thus, the shower curtain 26 is obstructed from billowing towards a person who is showering. This is desirable when the person is capable of showering alone but is particularly helpful when the person is disabled such that they need assistance from another person when showering.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A shower curtain holding assembly comprising:

a pole member having a first end and a second end;

a first hook member coupled to said first end of said pole member;

a second hook member coupled to said second end of said pole member;

said first hook member and said second hook member being adapted for coupling to a support structure proximate a shower curtain such that said pole member is supported adjacent to the shower curtain whereby said pole member restricts movement of the shower curtain;

a first line extending between said pole member and said first hook member;

a second line extending between said pole member and said second hook member; and said first hook member and said second hook member being adapted for coupling to a shower curtain rod supporting a shower curtain such that said pole member is supported adjacent to the shower curtain in spaced relationship with the shower curtain rod by said first line and said second line whereby said pole member restricts movement of the shower curtain.

2. The shower curtain holding assembly of claim 1, wherein said pole member is extendable such that said pole member is adapted for extending across a full width of the shower curtain.

3. The shower curtain holding assembly of claim 1, wherein said first line has a length equal to a length of said second line whereby said pole member is adapted for being positioned parallel to the shower curtain rod.

4. The shower curtain holding assembly of claim 1, wherein said first line and said second line are constructed of a non-absorbent material.

5. The shower curtain holding assembly of claim 1, wherein said first line and said second line are coated by a non-absorbent material.

6. The shower curtain holding assembly of claim 1, further comprising:

a first stopper coupled to said first end of said pole member;

a second stopper coupled to said second end of said pole member; and wherein said first stopper and said second stopper are adapted for frictionally engaging opposite walls proximate the shower curtain to facilitate holding said pole member in a static position.

7. The shower curtain holding assembly of claim 2, further comprising:

a first suction cup coupled to said first hook member such that said first hook member is adapted for being secured to a first surface; and a second suction cup coupled to said second hook member such that said second hook member is adapted for being secured to a second surface opposite the first surface whereby said pole member is adapted for being secured in place.

8. The shower curtain holding assembly of claim 7, further comprising:

a first loop member coupled said first end of said pole member, said first loop member being coupled to said first hook member; and a second loop member coupled to said second end of said pole member, said second loop member being coupled to said second hook member.

9. The shower curtain holding assembly of claim 2, further comprising:

said first hook member having an arcuate portion, said arcuate portion having a radius greater than a radius of said pole member such that said first hook member is adapted for insertion through a shower curtain ring while said first hook member simultaneously receives said pole member whereby said pole member is adapted for being positioned transverse to the shower curtain rod.

10. A shower curtain holding assembly comprising:

a pole member having a first end and a second end;

a first hook member coupled to said first end of said pole member;

a second hook member coupled to said second end of said pole member;

a first line extending between said pole member and said first hook member;

a second line extending between said pole member and said second hook member;

said first hook member and said second hook member being adapted for coupling to a shower curtain rod supporting a shower curtain such that said pole member is supported adjacent to the shower curtain in spaced relationship with the shower curtain rod by said first line and said second line whereby said pole member restricts movement of the shower curtain;

wherein said pole member is extendable such that said pole member is adapted for extending across a full width of the shower curtain;

wherein said first line has a length equal to a length of said second line whereby said pole member is adapted for being positioned parallel to the shower curtain rod;

a first stopper coupled to said first end of said pole member;

a second stopper coupled to said second end of said pole member;

wherein said first stopper and said second stopper are adapted for frictionally engaging opposite walls proximate the shower curtain to facilitate holding said pole member in a static position;

said first hook member having an arcuate portion, said arcuate portion having a radius greater than a radius of said pole member such that said first hook member is adapted for insertion through a shower curtain ring while said first hook member simultaneously receives said pole member whereby said pole member is adapted for being positioned transverse to the shower curtain rod.

11. The shower curtain holding assembly of claim 10, wherein said first line and said second line are constructed of a non-absorbent material.

12. The shower curtain holding assembly of claim 10, wherein said first line and said second line are coated by a non-absorbent material.

13. A shower curtain holding assembly comprising:

a pole member having a first end and a second end;

a wall hook member adapted for coupling to a wall proximate a shower curtain;

a wall mount member adapted for coupling to a second wall proximate the shower curtain;

said second end of said pole member being pivotally coupled to said wall mount member such that said pole member is pivotable between a use position and a storage position; and a first end loop member coupled and extending from said first end of said pole member, said first end loop member being positioned to engage said wall hook member when said pole member is pivoted into said use position such that said pole member is supported adjacent to the shower curtain whereby said pole member restricts movement of the shower curtain.

14. The shower curtain holding assembly of claim 13, wherein said pole member is retractable for facilitating pivoting said pole member into said storage position.

15. The shower curtain holding assembly of claim 13, wherein said wall hook member is positioned relative to said wall mount member such that said pole member is adapted for positioning parallel to a shower curtain rod supporting the shower curtain.

16. The shower curtain holding assembly of claim 13, wherein a hook portion of said wall hook member is covered by an elastomeric material.

* * * * *